US010316488B2

(12) United States Patent
Nair et al.

(10) Patent No.: US 10,316,488 B2
(45) Date of Patent: Jun. 11, 2019

(54) UNIVERSAL BACKHOE COUPLER

(71) Applicant: CNH Industrial America LLC, New Holland, PA (US)

(72) Inventors: Vikram Nair, Muscatine, IA (US); David J. Sanning, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 15/267,676

(22) Filed: Sep. 16, 2016

(65) Prior Publication Data

US 2018/0080191 A1 Mar. 22, 2018

(51) Int. Cl.
*E02F 3/36* (2006.01)

(52) U.S. Cl.
CPC ..... *E02F 3/3604* (2013.01); *E02F 3/3622* (2013.01); *E02F 3/3631* (2013.01)

(58) Field of Classification Search
CPC ..... E02F 3/3604
See application file for complete search history.

(56) References Cited

U.S. PATENT DOCUMENTS

| | | | | |
|---|---|---|---|---|
| 4,133,121 | A | 1/1979 | Hemphill | |
| 4,207,693 | A | 6/1980 | Hemphill | |
| 4,436,477 | A | 3/1984 | Lenertz et al. | |
| 4,452,560 | A | 6/1984 | Coyle | |
| 5,256,026 | A | 10/1993 | Kishi | |
| 5,927,665 | A | 7/1999 | Grabnic | |
| 6,233,852 | B1 | 5/2001 | Pemberton | |
| 6,364,561 | B1 | 4/2002 | Droegemueller | |
| 6,508,616 | B2 | 1/2003 | Hung | |
| 6,922,926 | B2 | 8/2005 | Miller et al. | |
| 7,770,311 | B2 | 8/2010 | Hahnel | |
| 7,779,562 | B1 | 8/2010 | Loveless | |
| 8,622,645 | B2 | 1/2014 | Hill | |
| 9,284,712 | B2 | 3/2016 | Bradley et al. | |
| 2003/0095858 | A1 | 5/2003 | Mantovani | |
| 2013/0164080 | A1* | 6/2013 | Miller | E02F 3/3604 403/327 |
| 2015/0345104 | A1* | 12/2015 | Bradley | E02F 3/3604 414/723 |

FOREIGN PATENT DOCUMENTS

| | | | |
|---|---|---|---|
| EP | 1586709 | A2 | 10/2005 |
| JP | H07305374 | A | 11/1995 |
| JP | H08226139 | A | 9/1996 |

OTHER PUBLICATIONS

European Search Report for European Application No. 17190795.9 dated Feb. 16, 2018 (7 pages).

* cited by examiner

*Primary Examiner* — Ronald P Jarrett
(74) *Attorney, Agent, or Firm* — Peter K. Zacharias; Patrick M. Sheldrake

(57) ABSTRACT

A universal backhoe bucket coupler for a work machine includes a first pair of apertures positioned to be spanned by the mounting flanges of a first style bucket having mounting holes for receiving at least one front mounting pin, a second pair of apertures positioned to be spanned by the mounting flanges of a second style bucket having mounting holes for receiving at least one front mounting pin. A pair of like pivotal spacers is disposed laterally intermediate corresponding outer and inner side portions of the coupler and are pivotable between stowed positions and deployed positions aligned with the first pair of apertures for minimizing lateral bucket motion.

15 Claims, 4 Drawing Sheets

UNIVERSAL BACKHOE COUPLER

FIELD OF THE INVENTION

The present invention relates to work machines such as tractor loader backhoe units, and more specifically to a universal bucket connector for such devices.

BACKGROUND OF THE INVENTION

A common work machine utilized in the construction field is a tractor loader backhoe which has a loader on the front of the tractor and a backhoe on the rear portion. There are a number of manufacturers of tractors for this purpose as well as bucket styles for the backhoe sections. The variety of equipment has generated a need for universal couplers designed to easily connect the tractor to the bucket of a backhoe assembly. The backhoe buckets are typically attached by a rear mounting pin which is received in a C-shaped slot which may be configured to accommodate a variety of rear pin types. Terms such as "rear", "front", "right", etc. as used herein are from the operator's point of view—typically rearward—away from the loader portion. The front mounting pin configuration for the different bucket styles varies, in terms of pin diameter, spacing from the C-shaped slot, and in the lateral spacing or width of the flanges on the buckets. While a variation of diameter and distance from the C-shaped slot can be readily accommodated, it becomes much more difficult to adapt to a difference in lateral as well as longitudinal pin spacing.

One successful universal coupler for a backhoe assembly is shown in U.S. Pat. No. 9,284,712 wherein a first link is pivotally connected to the articulation joints of the backhoe assembly. Mounting holes for a first and third style bucket with equal lateral pin spacing are provided on the first link. A second link is connected to the first link and is pivotal between a first position in which the mounting holes are exposed and a second position in which the second link covers the holes on the first link and provides the mounting hole diameter and pin spacing for a bucket having a greater pin spacing. This coupler will accommodate either of two buckets of like pin spacing or a third bucket having a greater pin spacing.

What is needed in the art is additional versatility in accommodating backhoe buckets of varying pin spacing, mounting hole location and diameter.

SUMMARY OF THE INVENTION

In accordance with an aspect of the present invention, there is provided a coupler which accommodates buckets of differing pin location and diameter as well as a greater number of buckets of differing lateral pin spacing.

In accordance with another aspect of the present invention, there is provided a universal coupler for connecting multiple style buckets to the articulation joints of a single style work machine. The coupler has a pair of like multi-apertured outer side portions, a pair of like multi-apertured inner side portions partially spanned by the outer side portions, and a pair of like rearwardly extending slotted portions, each disposed laterally intermediate a corresponding outer side portion and inner side portion for receiving a rear bucket mounting pin. Each of a pair of pivotal spacers is disposed laterally intermediate a corresponding outer side portion and inner side portion. The spacers are pivotable between stowed positions and deployed positions aligned with a first pair of the inner side portion apertures for receiving apertured mounting flanges of a first style bucket and at least one front mounting pin. Lateral movement of the first style bucket is minimized by the interengagement of flange inner faces and the spacers. Further pairs of apertures of the inner side portions are positioned to be spanned by the mounting flanges of other style buckets.

In accordance with yet another aspect of the present invention, there is provided a work machine with mounting points for articulated movement of a bucket including a universal coupler for connecting multiple style buckets. The coupler has inner side portions with several longitudinally spaced apart pairs of apertures positioned to be spanned by the mounting flanges of several different style buckets all having mounting holes for receiving at least one front mounting pin. Lateral motion of certain style buckets is minimized by the interengagement of outer faces of the inner side portions of the coupler with inner faces of the bucket flanges. Lateral motion of other style buckets may be minimized by spacers interposed between the outer faces of the inner side portions and the inner faces of the bucket flanges. Lateral motion of further style buckets may be minimized by the interengagement of rearwardly extending rear mounting pin receiving slotted portions of the coupler with inner faces of the bucket flanges.

An advantage of the embodiment described herein is the optional use of non load bearing spacers incorporated in the design of the coupler to prevent side to side movement of the bucket on the coupler.

Another advantage is the embodiment described herein allows for spacers to be kept and stored on the coupler when not in use thereby insuring the correct spacers are used.

Yet another advantage is the embodiment described herein allows for the spacers to be rotated out of the way when not needed allowing additional clearance for alternate attachments.

BRIEF DESCRIPTION OF THE DRAWINGS

The above-mentioned and other features and advantages of this invention, and the manner of attaining them, will become more apparent and the invention will be better understood by reference to the following description of an exemplary embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
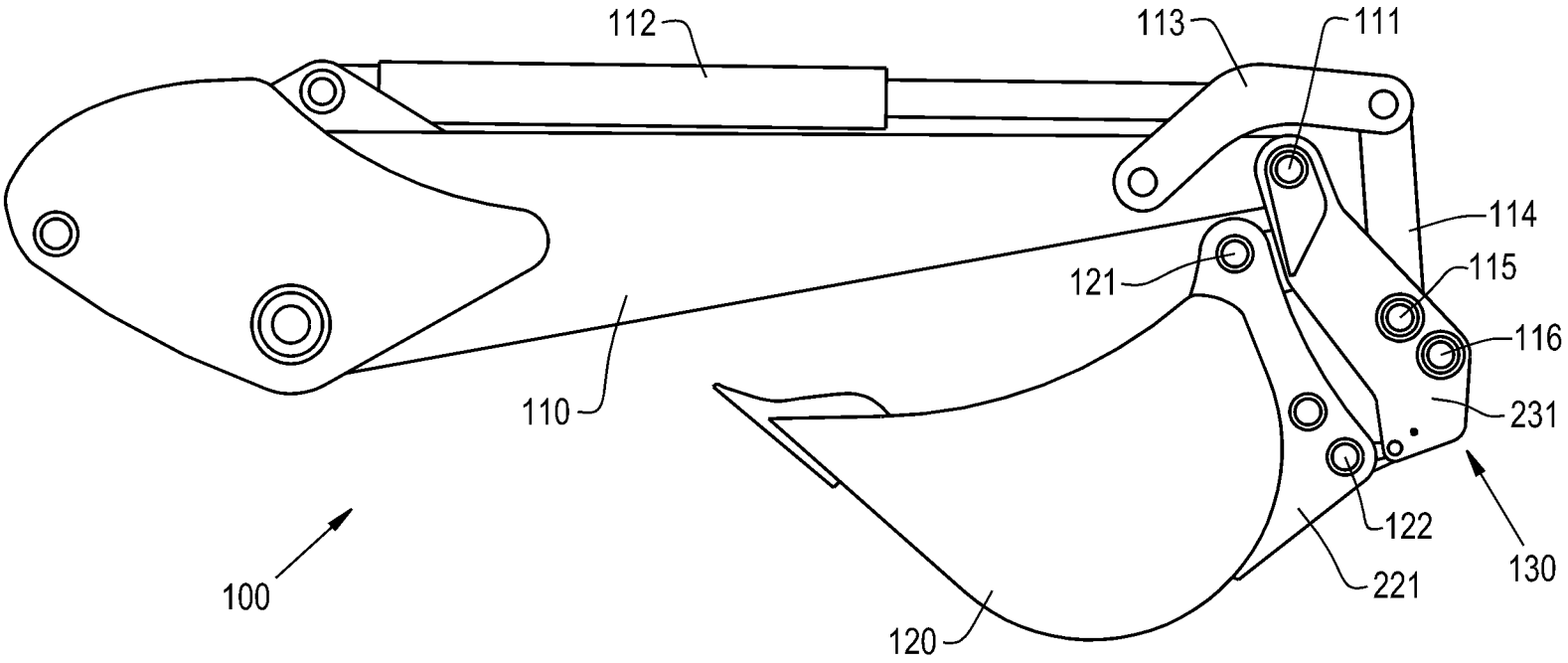
FIG. 1 is a side elevation view of a portion of a backhoe assembly showing a work machine arm and first style bucket joined by a coupler according to an exemplary embodiment of the present invention.

Referring now to the drawings, and more particularly to FIG. 1, there is shown a portion of a work machine 100 which generally includes a conventional articulated arm 110 pivotable under operator control through a limited range of angles about both a vertical axis and a horizontal axis. A first style bucket 120 is pivotally coupled to the free end of the arm 110 by a pivot pin 111 and coupler 130. A dump link mechanism includes a hydraulic cylinder 112 which extends from near the base of the arm 110 to engage a link 113. One end of link 113 is pivotally connected near the free end to the arm 110 and the other end is connected by a further link 114 to the coupler 130. The bucket 120 and coupler 130 assembly is pivotable through a limited range of angles about the generally horizontal axis of the pivot pin 111 under operator control of the cylinder 112. When the operator causes the piston rod to extend, link 113 is pivoted clockwise as viewed in FIG. 1 causing link 114 to move downward and the bucket and coupler assembly pivots clockwise. Retracting the piston rod causes counter-clockwise bucket and coupler rotation.

A lever arm is formed by the separation between the pivotal connection at 111 and the pin 115 of link 114. A longer lever arm and resulting greater force-less range of motion connection is achieved by moving the link 114 to be coupled by a pin passing through aperture 116 in the coupler 130. Aperture 116 as well as several other apertures in the outer side portions may be provided with the illustrated bushings if desired. The bucket 120 has a rear mounting pin 121, normally fixed to the bucket, which may be received in rearwardly opening C-shaped rear bucket pin slots 323 (FIGS. 3) and 424 (FIG. 4). The front mounting pin 122 may then be passed through both bucket flanges 221 and 222, as well as the coupler 130 fixing the buck in position.

Figure 2:
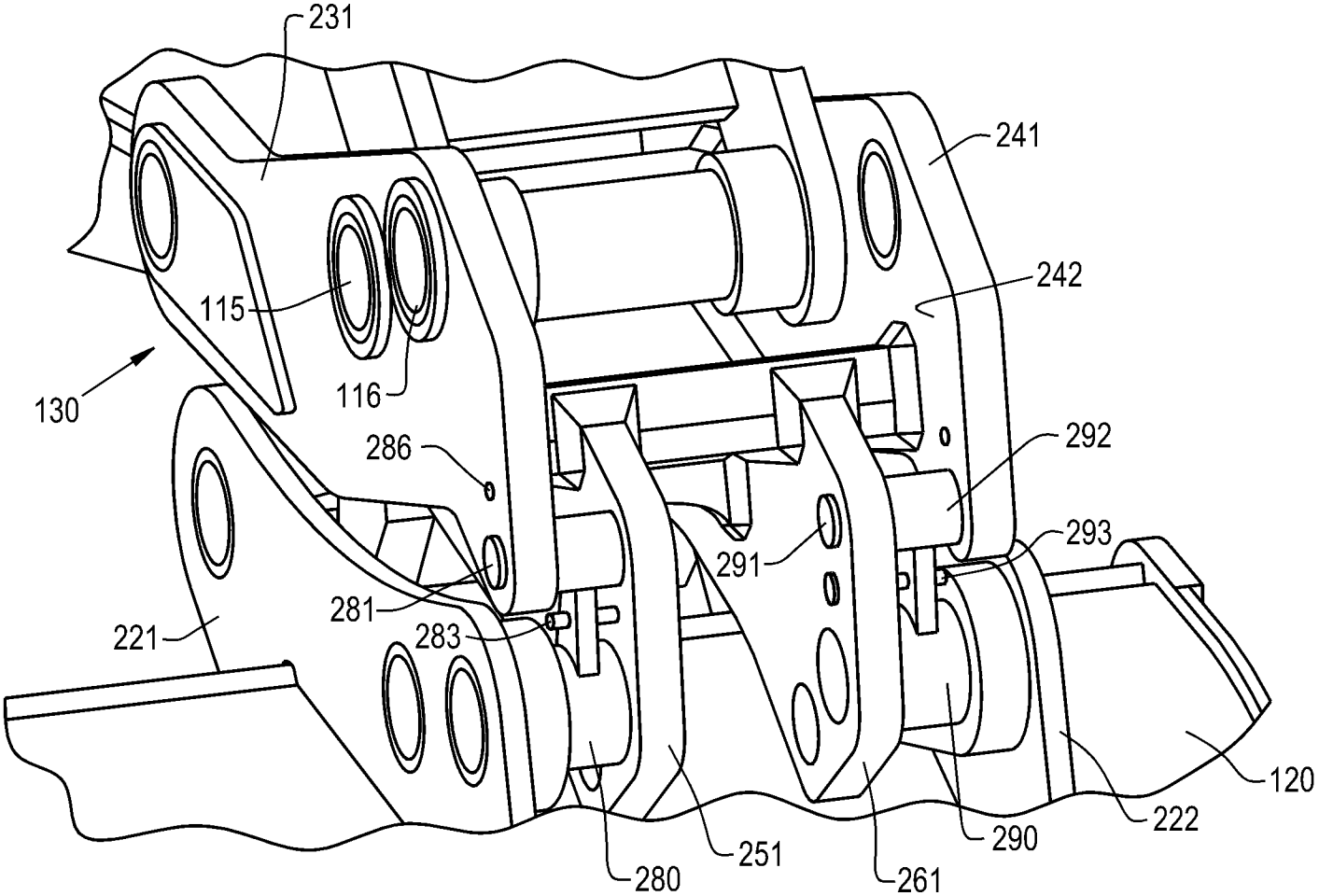
FIG. 2 is an isometric view of a portion of the backhoe assembly of FIG. 1 as seen from the dipper end.

In FIG. 2, coupler 130 is formed as a pair of like multi-apertured outer side portions 231 and 241, and a pair of like multi-apertured inner side portions 251 and 261 partially spanned by the outer side portions. There are also a pair of like rearwardly extending slotted portions 471 (FIGS. 4) and 381 (FIG. 3), each disposed laterally intermediate a corresponding outer side portion and inner side portion for receiving a rear mounting pin. For example, rearwardly extending portion 381 lies intermediate the outer surface or face 262 of inner portion 261 and the inner surface or face 242 of outer portion 241, compare FIGS. 2 and 3. The pairs of outer, inner and rearwardly extending portions may be individual steel plates permanently joined by welding. The members of each pair are essentially identical or at least mirror images of one another. The coupler may also be formed of a lesser number of parts by casting, forging or other suitable techniques.

Figure 3:
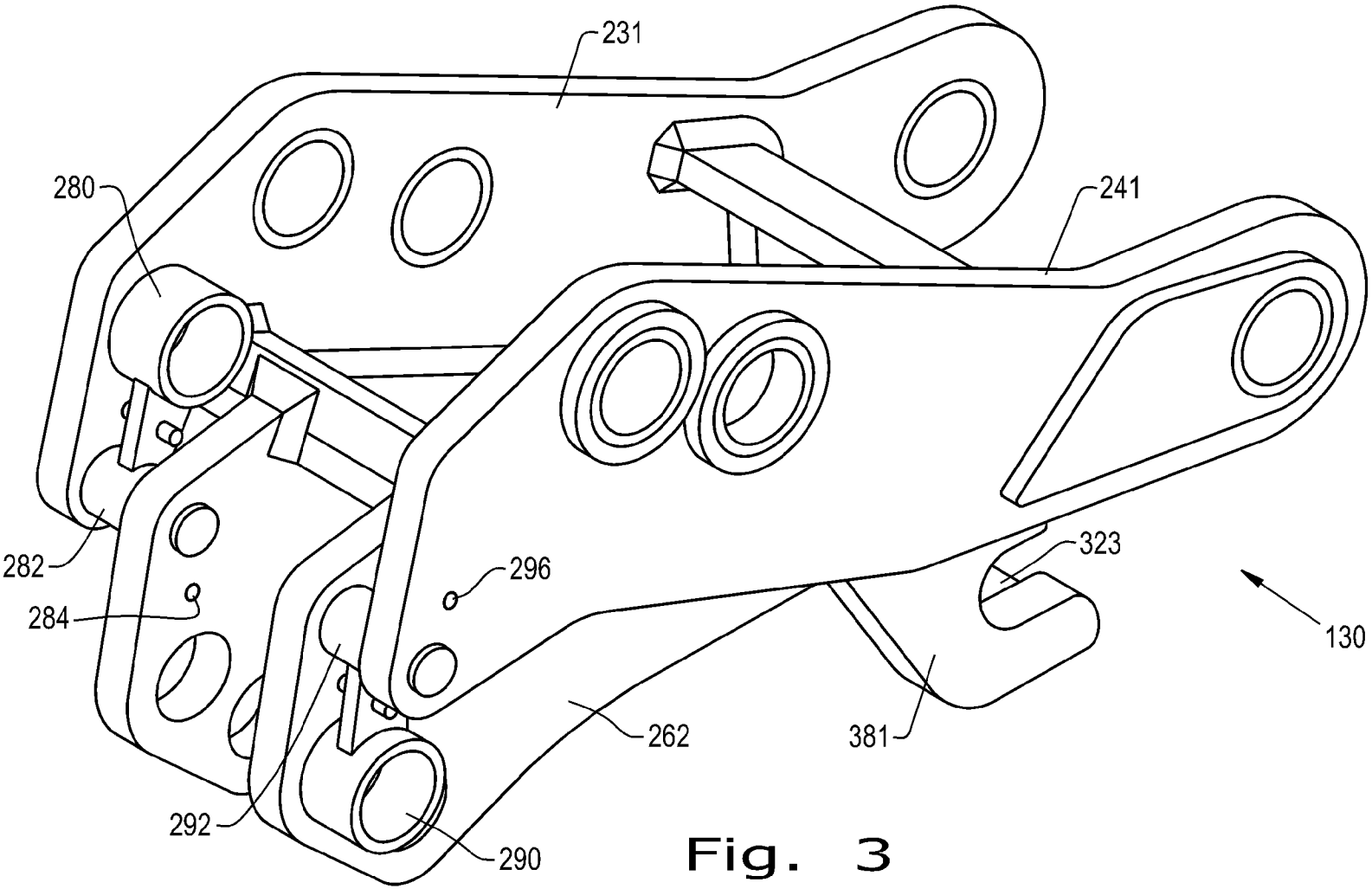
FIG. 3 is an isometric view of the coupler of FIGS. 1 and 2.
Figure 4:
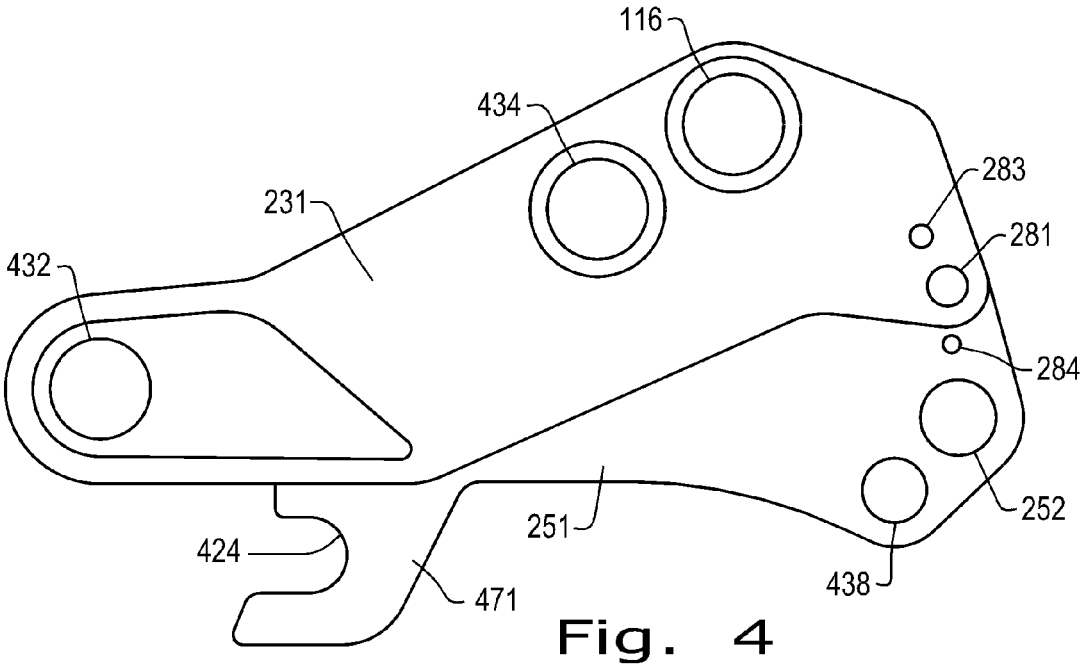
FIG. 4 is a side elevation view of the coupler from the right side of FIG. 3.

FIGS. 2 and 3, a pair of like pivotal spacers 280 and 290 is disposed laterally intermediate corresponding outer side portions and inner side portions. The spacers are pivotable between stowed positions and deployed positions aligned with a first pair of apertures 252 (and a like hole in portion 261) of the inner side portion for receiving apertured mounting flanges of a first style bucket and at least one front mounting pin as shown in FIGS. 1 and 2. The spacers are pivotally held within the coupler by respective pivot support or hinge pins 281 and 291 passing through hinge portions 282 and 292. As can be seen in FIGS. 2 and 3, hinge portion 282 fills a separation distance between inner side portion 251 and outer side portion 231; and likewise hinge portion 292 fills a separation distance between inner side portion 261 and outer side portion 241. In FIG. 3, spacer 280 is shown in a stowed position while spacer 290 is deployed for filling the space between the inner face of flange 222 and the outer face 262 of inner portion 261. As can be seen in FIG. 3 spacers 280 and 290 are generally cylindrical having a cylindrical aperture therethrough and are coupled to hinge portions 282 and 292 respectively. Spacers are retained in either the deployed or the stowed position by locking or latching pins 283 and 293 which engage one of the two locking pin apertures 284 or 286, and 294 or 296. Lateral bucket movement is minimized by the interengagement of bucket flange inner faces and the spacers.

FIG. 4 is a right side elevation view of the coupler 130. Aperture 432 is for receiving the pivotal pin 111. Link 114 is connected by pin 115 to either aperture 434, the maximum amplitude hole, or aperture 116, the maximum power hole. Latching or lock pin aperture 286 receives locking pin 283 retaining the spacer 280 in the stowed position. In this configuration, latching hole 284 is unused. Apertured inner side portion 251 has two apertures 252 and 438, each positioned relative to the rear bucket pin slot 424 for receiving the front mounting pin of a specific style bucket.

Figure 5:
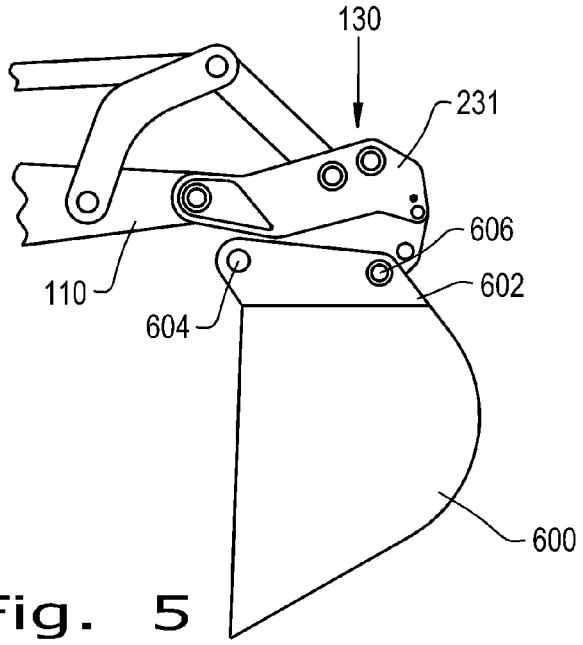
FIG. 5 is a side elevation view of a second style bucket joined with a work machine arm and the coupler of FIGS. 3 and 4.

In FIG. 5, a second style bucket 600 is illustrated coupled to the work machine. Bucket 600 has a single pair of mounting flange such as 602 with the rear mounting pin 604 engaging slots 323 and 424, and the front mounting pin 606 passing through aperture 438.

The bucket 120 has the greatest transverse separation between mounting flange inner surfaces as well as the greatest longitudinal distance between front and rear mounting pin locations of the two bucket styles discussed. Lateral movement (slop) of bucket 120 is minimized by the spacers 280 and 290. Bucket 600 has the least space between front and rear mounting pin locations and a separation between inner flange surfaces less than that of the other bucket style. This separation is compensated by bucket flange engagement with the outer surfaces of the rear portions 472 and 381.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A universal coupler for connecting multiple style buckets to the articulation joints of a single style work machine, said coupler comprising:

a pair of like multi-apertured outer side portions including a first outer side portion and a second outer side portion;

a pair of like multi-apertured inner side portions partially spanned by the outer side portions, the pair of like multi-apertured inner side portions including a first inner side portion and a second inner side portion, the first inner side portion being closer to the first outer side portion than to the second outer side portion and the second inner side portion being closer to the second outer side portion than to the first outer side portion;

a pair of like rearwardly extending slotted portions including a first rearwardly extending slotted portion and a second rearwardly extending slotted portion, the first rearwardly extending portion being laterally intermediate the first outer side portion and the first inner side portion for receiving a rear mounting pin, the second rearwardly extending portion being laterally intermediate the second outer side portion and the second inner side portion for receiving the rear mounting pin; and a pair of like pivotal spacers, each disposed laterally intermediate of the corresponding outer side portion and inner side portion, one of the pivotal spacers being between the first outer side portion and the first inner side portion, another of the pivotal spacers being between the second outer side portion and the second inner side portion, the spacers having a cylindrical aperture therethrough, the spacers pivotable between stowed positions and deployed positions aligned with a first pair of apertures of the inner side portions for receiving apertured mounting flanges of a first style bucket and at least one front mounting pin.

2. The universal coupler of claim 1, wherein lateral movement of at least one of the styles of buckets is minimized by the interengagement of mounting flange inner faces and the spacers.

3. The universal coupler of claim 1, wherein a second pair of apertures of the inner side portions are positioned to be spanned by mounting flanges of a second style bucket having mounting holes for receiving the at least one front mounting pin.

4. The universal coupler of claim 3, wherein lateral movement of the second style bucket is minimized by the interengagement of the flange inner faces and the outer surfaces of the inner side portions.

5. The universal coupler of claim 1, wherein said pairs of outer, inner and rearwardly extending portions are individual steel plates permanently joined by welding.

6. The universal coupler of claim 1, wherein a second pair of apertures of the inner side portions are positioned to be spanned by mounting flanges of a second style bucket having mounting holes for receiving the at least one front mounting pin, lateral movement of the second style bucket being minimized by the interengagement of the flange inner faces and the outer surfaces of the inner side portions.

7. The universal coupler of claim 1, wherein each outer side portion includes a first aperture for pivotally fastening the coupler with the dipper end of a backhoe arm.

8. The universal coupler of claim 7, wherein each outer side portion further includes a second aperture for connecting the coupler and a dump link mechanism associated with the backhoe arm.

9. The universal coupler of claim 1, wherein each spacer is pivotally supported by a pivot pin extending between corresponding apertures in respective outer and inner side portions.

10. The universal coupler of claim 9, wherein each spacer includes an associated latching pin operable in conjunction with a latching hole in the adjacent inner side portion for retaining the spacer in alignment with a corresponding one of the first pair of apertures.

11. The universal coupler of claim 10, wherein the latching pin is further operable in conjunction with a latching hole in the adjacent outer side portion for retaining the spacer in the stowed position.

12. A work machine comprising mounting points for articulated movement of a bucket including a universal coupler for connecting multiple style buckets to the work machine, said coupler comprising:

a pair of like multi-apertured outer side portions including a first outer side portion and a second outer side portion;

a pair of like multi-apertured inner side portions partially spanned by the outer side portions, the pair of like multi-apertured inner side portions including a first inner side portion and a second inner side portion, the first inner side portion being closer to the first outer side portion than to the second outer side portion and the second inner side portion being closer to the second outer side portion than to the first outer side portion;

a pair of like rearwardly extending slotted portions, including a first rearwardly extending slotted portion and a second rearwardly extending slotted portion, the first rearwardly extending portion being laterally intermediate the first outer side portion and the first inner side portion for receiving a rear mounting pin of one of multiple styles of buckets, the multiple styles of buckets including a first style bucket and a second style bucket, the second rearwardly extending portion being laterally intermediate the second outer side portion and the second inner side portion for receiving the rear mounting pin;

a first pair of apertures of the inner side portions positioned to be spanned by mounting flanges of the first style bucket having mounting holes for receiving at least one front mounting pin;

a second pair of apertures of the inner side portions positioned to be spanned by mounting flanges of the second style bucket having mounting holes for receiving the at least one front mounting pin; and a pair of spacers, a corresponding one of the pair of spacers being respectively pivotally coupled between one of the outer side portions and one of the inner side portions.

13. The work machine of claim 12, wherein when the coupler receives the first style bucket, inner side portions of the first style bucket flanges are spaced from the outer surfaces of the inner side portions and the space therebetween filled by respective ones of the spacers to minimize unwanted lateral bucket movement.

14. The work machine of claim 13, wherein the pair of spacers are pivotally suspended between corresponding inner surfaces of the outer side portions and outer surfaces of the inner side portions for pivotal motion between stowed positions and deployed positions intermediate the coupler and bucket flanges.

15. The work machine of claim 14, wherein when the coupler receives the second style bucket, the inner side portions of the second style bucket flanges are in close proximity to the outer surfaces of the inner side portions to minimize unwanted lateral bucket movement.

* * * * *